United States Patent [19]

Goto

[11] 4,214,567

[45] Jul. 29, 1980

[54] INTERNAL COMBUSTION ENGINES

[75] Inventor: Enami Goto, Yokohama, Japan

[73] Assignee: Kunihiko Miyaji, Tokyo, Japan

[21] Appl. No.: 954,201

[22] Filed: Oct. 24, 1978

[30] Foreign Application Priority Data

Oct. 11, 1978 [JP] Japan ..... 53/124798

[51] Int. Cl.[2] ..... F02B 75/02; F02P 1/10; F01L 13/08

[52] U.S. Cl. ..... 123/169 C; 123/76; 123/182

[58] Field of Search ..... 123/26, 75 B, 148 A, 123/182

[56] References Cited

U.S. PATENT DOCUMENTS

| | | | |
|---|---|---|---|
| 960,752 | 6/1910 | White | 123/182 |
| 962,653 | 6/1910 | Morrill | 123/182 |
| 2,534,860 | 12/1950 | Fisher | 123/182 |
| 3,040,725 | 6/1962 | Grisbrook | 123/182 |

*Primary Examiner*—Wendell E. Burns
*Attorney, Agent, or Firm*—Fleit & Jacobson

[57] ABSTRACT

The invention relates to internal combustion engines operatable with ignition plug. For each engine cylinder, secondary air introduction means are provided which utilizes at least part of the intake passage, screw thread gaps around the plug. In this case, use of non-return valve means and of air precompression means is not made in any way.

6 Claims, 9 Drawing Figures

INTERNAL COMBUSTION ENGINES

BACKGROUND OF THE INVENTION

This invention relates generally to improvements in and relating to two and four cycle internal combustion engines, and more particularly it relates to improved spark plugs for use therewith.

For the internal combustion engines of the above kind, the fuel air ratio is so designed for attaining maximum ignitability, thereby the fuel/air mixture being rather poor in its oxygen content in comparison with that which is necessary for the realization of optimal and perfect combustion of the fuel component.

Various proposals have, therefore, been made for introducing certain amount of secondary air into the engine cylinders.

Conventionally for this purpose, an auxiliary combustion chamber having a secondary air inlet is provided, preferably in the cylinder cover or on the piston head. As an alternative proposal, a swirling auxiliary chamber is provided for the similar purpose. As a still further proposal, two ignition plugs are provided in place of the regular single one and per engine cylinder.

In these cases, however, the regular design of the engine cylinder, especially the cover thereof, must be modified so as to introduce the secondary air.

SUMMARY OF THE INVENTION

The engine according to this invention is characterized by that each of the engine cylinder cover portions is provided with secondary air introduction means which utilize the plugfitted screw gaps as such air-introducing passage which is not provided with any non-return valve means. There is also no pump means for pressurizing the secondary air. Thus, the ambient atmospheric air is utilized as the source of the secondary air. To a surprising fact, compressed air or the high pressure combustion gases can not escape from the interior space of the engine cylinder into the ambient atmosphere.

It is, therefore, a main purpose of the present invention to provide an improved internal combustion engine adapted for introducing secondary combustion air into the engine cylinder, and indeed, without providing substantially any modification to the engine cylinder or its piston.

This and further objects, features and advantages of the invention will appear from the following detailed description of the invention to be set forth with reference to the accompanying drawings, illustrating several preferred embodiments of the invention.

PREFERRED EMBODIMENTS OF THE INVENTION

In the following, several preferred embodiments of the invention will be described with reference to the accompanying drawings.

Figure 1:
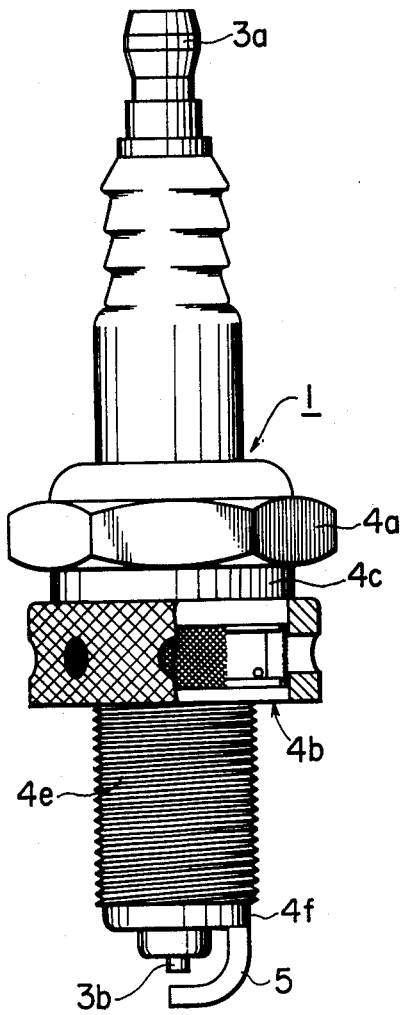
FIG. 1 is a partially broken-away, partially sectioned vertical elevation of an improved spark plug assembly adapted for attachment to cylinder cover of the engine cylinder.
Figure 2:
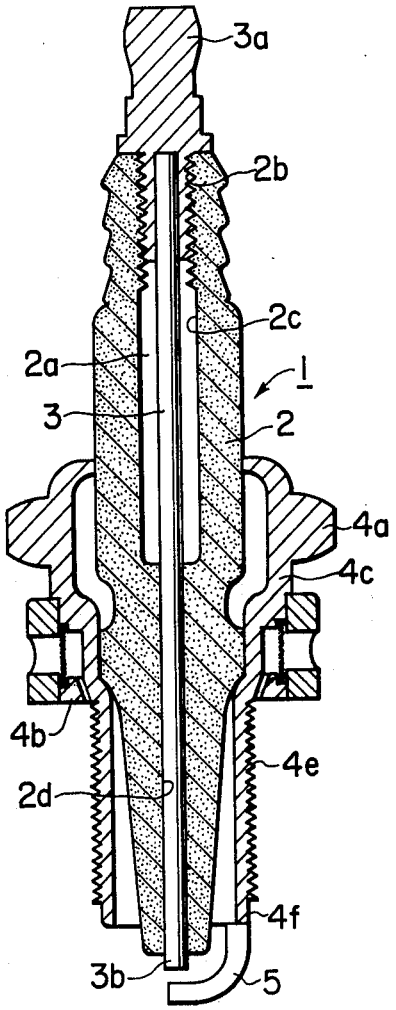
FIG. 2 is a longitudinal section of the plug assembly shown in FIG. 1.
Figure 3:
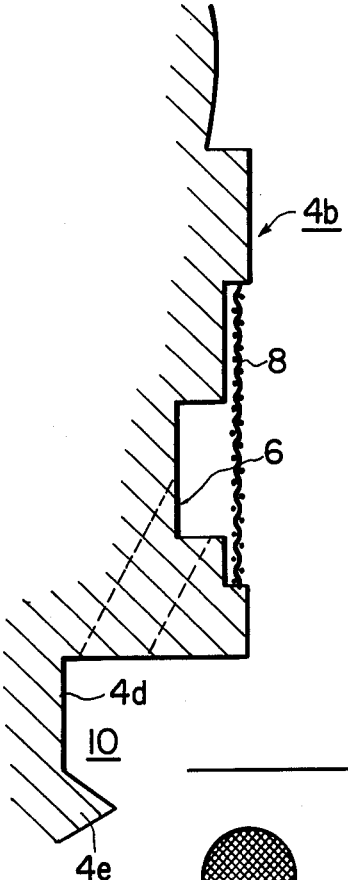
FIG. 3 is an enlarged partial view of the plug shown in FIG. 2.

In the first embodiment in FIGS. 1–3, numeral 1 denotes generally the plug assembly, comprising a ceramic sleeve 2, a central electrode 3 and an outside metal casing 4, as conventionally. The upper end of rod electrode 3 is formed into an electric terminal **3*a*, while the lower end of same acts as central igniting electrode 3*b* as is commonly known. The terminal head 3*a* may be a separate member which is pressed onto the top end of the rod electrode proper as shown. Central bore of the ceramic sleeve 2 is shown at 2*a*, into which the rod electrode 3 is inserted from upper and held in position by the provision of screw connection 5 between the rod and the sleeve The metal casing 4 surrounds the lower half of ceramic sleeve 2 and is formed near its top end with a nut portion 4*a* adapted for screwing attachment of the plug assembly to an tapped hole formed in the engine cylinder cover to be described. Further, the casing 4 is formed with a slightly projecting ring portion 4*b* having a perforated structure adapted for introduction of secondary air, an intermediate flat ring area 4*c* being formed between the nut portion 4*a* and the ring projection 4*b*. The lower part of casing 4 is formed with male-threaded portion 4*e*. A flat ring recess 4*d* is formed on the metal casing between the ring projection 4*b* and the threaded portion 4*e*, as specifically shown in FIGS. 3 and 4, while it has been omitted from FIGS. 1 and 2 for avoiding a crowded representation in the latter. Near the bottom end of the casing 4, there is provided a threadless ring area 4*f*. At the bottom end of the casing, an earthed electrode 5 is fixedly attached, as conventionally, in opposition to the central electrode 3*b***. There is a spark gap between these both electrodes.

The ring projection **4*b* is formed on its entire peripheral ring surface with a radially stepped concentric ring recess 6 acting as an air distributing channel, as will be more fully later described, said recess being kept in connection with a plurality of inclined passage ducts 7** which are drilled inclinedly through the lower portion of the ring projection.

In the stepped and larger outer portion of the ring recess, there is positioned a ring-shaped wire gauze net 8 for filtering the introduced secondary air to be described. Under occasion, however, this wire net can be removed. The number of inclined air ducts 7 may be 6 or 8 in number and arranged with mutual equidistance and thus in a radial manner when seen from upper of the plug assembly.

A cover ring 9 is press-fit on the outer peripheral surface of ring projection **4*b* and formed with a plurality of radial inlet opening 9*a*** for introducing the secondary air.

Figure 4:
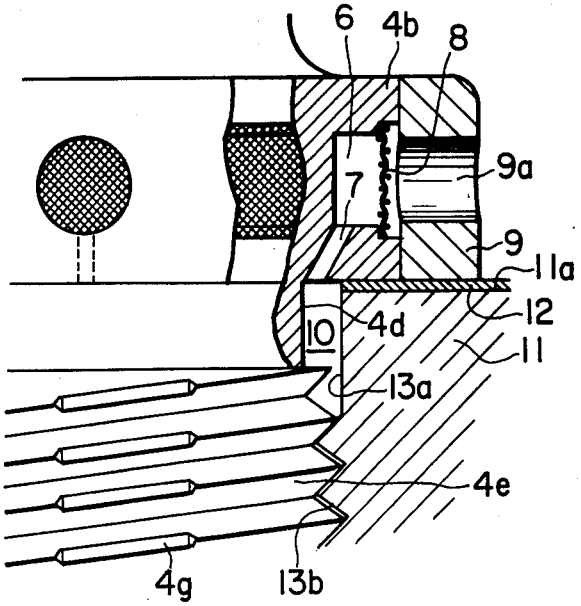
FIG. 4 is an enlarged partially sectioned partial view of the plug assembly which has been attached to an engine cylinder cover shown only partially.

In FIG. 4, numeral 11 represents an engine cylinder cover only partially, the flat top surface thereof being shown at **11*a*. A plug-fitting opening is also seen only partially, this opening being composed of an upper enlarged plain hole part 13***a* and a lower female-threaded hole part 13*b*. The lower portion thereof is kept in communication with the related cylinder bore, although not shown.

The screw gaps formed necessarily between the male-threads 4*e* of the plug assembly and the female threads 13*b* of the plug-receiving opening in the cylinder cover may be left in usual regular dimensional range. However, when occasion desires, screws may be only slightly filed off on the entire cylindrical surface of the plug screw or the bore screw, or at the both.

Numeral 4*g* represents a slightly filed-off band-like surface formed on the plug screw. Such vertically extending bands may be several in number and applied in an radial manner.

In the operation of the engine, secondary air is introduced from ambient atmosphere through lateral openings 9*a*, wire net 8, air-distributing ring space 6 and inclined ducts 7 into ring space 10 which acts like a kind of air-distributing chamber. Then, the air will be conveyed therefrom through the plug screw gaps into the engine cylinder bore.

Although such secondary air intake takes place with definiteness in practice and serves substantially for the improvement of thermal efficiency of the engine, the introducing mechanism is somewhat difficult to determine. For attaining such introduction of the secondary air, at least a limited space part around the tip end of the plug assembly within the cylinder or all the cylinder space must be governed by a negative pressure. At present, however, I can not determine if the secondary air introduction takes place during the suction or intake stroke or explosion stroke of the engine. Anyhow, the invention provides a substantial improvement of the fuel consumption rate of the engine, improvement of the clearness of the exhaust gases from the engine, as well as those in the problem of engine vibration and exhaust noises.

In the foregoing description, the ring projection 4*b* provided with secondary air introducing means is made integral with the body of metal casing 4. However, it is possible to make this ring projection into a separate ring which is assembled with the filtering ring wire net and the cover ring 9 into a practically one piece. In this case, this ring assembly is formed into an additional ring adapted for attaching a conventional ignition plug assembly proper which has in this case no secondary air-introducing means.

Figure 5:
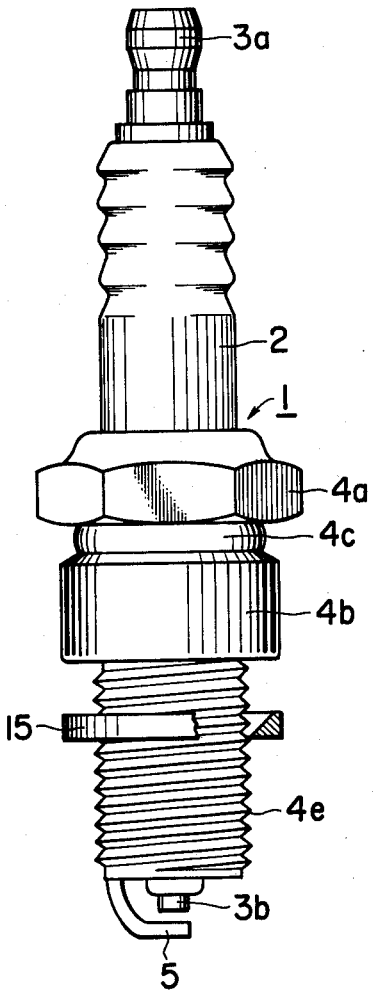
FIG. 5 is an elevational view, however, partially broken away and partially sectioned, of a slightly modified plug assembly according to the present invention.
Figure 6:
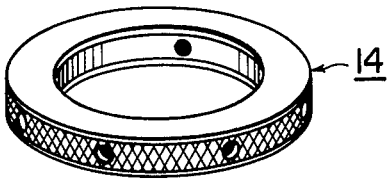
FIGS. 6–9 are several perspective views of secondary air introducing means which are to be arranged between a conventional ignition plug and an engine cylinder cover.

In FIG. 6, numeral 14 represents such an independent and separate ring assembly. For use such attachment ring, a hard fiber- or copper-made ring sheet 12 shown in FIG. 4 may be removed, if necessary. This attachment ring assembly 14 may be attached to the regular plug assembly as shown in FIG. 5, however in place of the member denoted 15.

Figure 7:
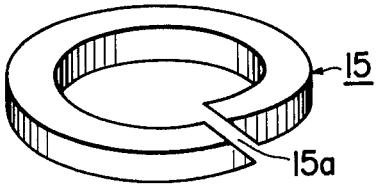

In FIGS. 5 and 7, numeral 15 represents a spring ring washer type attachment ring usable for the purpose of this invention. This ring 15 has a gap 15*a* which is designed to have an opening even when the ring has been heavily pressurized axially to such a degree that it takes a flat configuration and the skew opening is closed. Through the opening, secondary air will invade into the ring space defined by the inside wall surface of the washer, thence the air advances through the plug screw gaps towards the engine cylinder bore.

Figure 8:
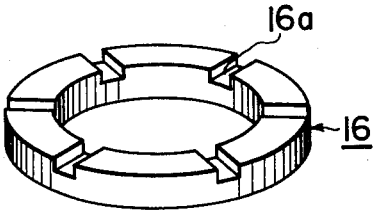

Numeral 16 in FIG. 8 represents a plain ring which is formed, however, a plurality of radial recesses 16*a*. When used in the manner similar to that shown in FIG. 5, this radially recessed ring 16 well serves as the secondary air introducing means proposed by the present invention.

Figure 9:
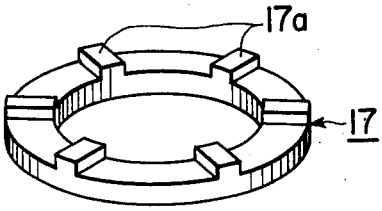

Numeral 17 in FIG. 9 represents a ring having a plurality of radial projections 17*a*. When placed in position between the plug and the cylinder cover, each gap formed between each two neighboring projections 17 acts as a radial inlet opening. This modified ring may be used in the position as shown, or in an up-and-down converted position. This fact can be equally applied to the ring 16 shown in FIG. 8.

With use of the secondary introducing means according to this invention and without use of any non-return valves, the desired secondary air introduction can be effected with definitness, as was already referred to. Any gas- or air leak from the engine cylinder does not take place during whole operation period through the plug screw gaps. This fact may be an astounding one to any person skilled in the art.

The air introduction mechanism is conceivable in two different ways. As the first, the secondary air may be introduced into the engine cylinder during the suction stroke of the engine, because a negative pressure prevails in the whole effective space of the cylinder.

With use of the inventive plug assembly, it is found that the engine suction pressure increases slightly in comparison with the regular values without use of the secondary air introduction. This fact can be ascertained by the practical engine test running as listed in the following several numerical tables. In this case, however, use of the air/fuel mixture leaner than the regular one would bring the desired thermal efficiency improvement. But, in fact, this could not apply. If the secondary air introduction taken in such manner as proposed by the present invention does not invite any misfire as may be supposed by any person skilled in the art.

On the other hand, in fact, even when a positive air or gas pressure prevails in the engine cylinder, as in the case of the compression or exhaust stroke of the engine, any air- or gas leak takes place from the cylinder into the atmosphere. Thus, an intake of the secondary air intake through plug screw-gaps seems unlikely to take place during the suction stroke of the engine. However, I cannot reach to make the final decision in which engine stroke period, the desired secondary air can take place.

As a second solution why such secondary air intake takes place in practice and through the plug thread gaps, it may be conceived that it happens during the explosion stroke, especially at the beginning stage thereof. At this stage, sparks ignite the fuel/air mixture which is then subjected to an explosion. The flames will generate at first around the spark gap and then propagate downwards. I suppose that at this moment a substantial negative pressure will generate around the plug tip end and establish communication with the ambient atmosphere through the plug screw gaps, and indeed, in the reverse direction as the already mentioned secondary air intake route. In this way, I suppose that the secondary air intake operation can take place. Although, I cannot find at least at the present moment either air intake mechanism is true to the fact. However, the second mode of intake operation is rather believable.

As to a question, why gas leak cannot take place during the explosion cycle period, and indeed, without any use of the non-return valve means, I consider that the gas pressure increases suddenly and almost instantly so that it acts dynamically and the plug screw threads can act as a kind of labyrinth seal. In practical engine running test, no gas leak can be found.

In the following, several test running data will be shown.

It will be seen from these results that fuel economy is largest at the engine idle running period. Next, the economy is realized during the high speed running period. During the middle speed running, economy is also realized, but the degree is not so much high. At the street running tests, where stops and starts of the vehicle are frequent the economy is also considerable.

Table 1 represents results of comparative tests. As the secondary air-introducing means, the first embodiment of plug shown in FIGS. 1–4 was used. The tested roads were substantially horizontal.

Table 2 shows results of a street running test.

Table 1

| Vehicle Speed, km/h | Use or non-use of improved plug | Engine revolutions, rpm | Suction pres., mmHg | Fuel consumption, cc |
|---|---|---|---|---|
| 40 | none | 1200 | 400 | 100 |
| | used | 1200 | 423 | 100 |
| 60 | none | 1500 | 410 | 100 |
| | used | 1500 | 415 | 100 |
| 80 | none | 2000 | 395 | 100 |
| | used | 2000 | 395 | 100 |
| 100 | none | 2500 | 360 | 100 |
| | used | 2500 | 367 | 100 |

| Vehicle Speed, km/h | Use or non-use of improved plug | Driven distance, km | Real vehicle speed | Fuel consumption rate, km/lit. | Degree of fuel consumption improvement, % |
|---|---|---|---|---|---|
| 40 | none | 0.85 | 40 | 8.5 | |
| | used | 1.15 | 40 | 11.5 | 35 |
| 60 | none | 0.91 | 60 | 9.1 | |
| | used | 0.98 | 60 | 9.8 | 7.6 |
| 80 | none | 0.90 | 80 | 9.0 | |
| | used | 0.94 | 80 | 9.4 | 4.4 |
| 100 | none | 0.81 | 100 | 8.1 | |
| | used | 0.88 | 100 | 8.8 | 8.6 |

Table 2

| Use or non-use of Invention | Fuel consumption rate. km/lit. | Degree of fuel consumption improvement, % |
|---|---|---|
| none | 6.8 | |
| used | 8.6 | 26.4 |

Table 3

| Vehicle Speed.km/h | Use or non-use of improved plug | Engine revolutions, rpm | Suction pres., mmHg | Fuel consumption, cc |
|---|---|---|---|---|
| 40 | none | 1200 | 400 | 100 |
| | used | 1200 | 410 | 100 |
| 60 | none | 1500 | 410 | 100 |
| | used | 1500 | 420 | 100 |
| 80 | none | 2000 | 395 | 100 |
| | used | 2000 | 399 | 100 |
| 100 | none | 2500 | 360 | 100 |
| | used | 2500 | 365 | 100 |

| Vechicle Speed, km/h | Use or non-use of improved plug | Driven distance, km | Real vehicle speed, km/h | Fuel consumption rate, km/lit. | Degree of fuel consumption improvment, % |
|---|---|---|---|---|---|
| 40 | none | 0.86 | 40 | 8.6 | |
| | used | 0.96 | 40 | 9.6 | 11.6 |
| 60 | none | 0.91 | 60 | 9.1 | |
| | used | 0.98 | 60 | 9.8 | 7.6 |
| 80 | none | 0.90 | 80 | 9.0 | |
| | used | 0.92 | 80 | 9.2 | 2.2 |

Table 3-continued

| | | | | | |
|---|---|---|---|---|---|
| 100 | none | 0.82 | 100 | 8.2 | |
| | used | 0.93 | 100 | 9.3 | 13.4 |

Table 3 shows similar results as those of Table 1.

Tables 4 and 5 show results of comparative tests on exhaust gases. The engine has a piston displacement volume of 1,400 cc in the case of Table 4, while it amounts to 1,800 cc in the case of Table 5.

Table 4

| | | HC | CO | $NO_x$ |
|---|---|---|---|---|
| Street running | conventional | 3.40 | 25.1 | 0.24 |
| test | inventive | 3.29 | 24.60 | 0.18 |
| Vehicle | conventional | 0.99 | 6.14 | 0.09 |
| speed 40km | inventive | 0.87 | 5.56 | 0.07 |
| Vehicle | conventional | 0.99 | 8.89 | 0.29 |
| speed 60km | inventive | 0.86 | 8.33 | 0.21 |

Table 5

| | | | | |
|---|---|---|---|---|
| Vehicle | 40km conventional | 0.85 | 3.89 | 0.40 |
| speed | 40km inventive | 0.80 | 3.65 | 0.34 |
| Vehicle | 60km conventional | 0.81 | 3.69 | 1.33 |
| speed | 60km inventive | 0.76 | 3.51 | 1.21 |
| Vehicle | 100km conventional | 0.75 | 6.83 | 3.27 |
| speed | 100km inventive | 0.66 | 6.20 | 3.03 |

As a result of substantially complete combustion of the fuel-air mixture, engine vibrations were also substantially improved. According to readings on a noise meter, 50% or so was improved in this respect.

Although the foregoing description has been directed to the four stroke cycle engines, substantially similar improvements have been obtained in the case of two stroke cycle engines.

The embodiments of the invention in which an exclusive property or privilege is claimed are as follows:

1. In an ignition plug for use with an internal combustion engine, the plug having a ceramic sleeve, a central electrode passing through the sleeve, and an outside metal casing surrounding the ceramic sleeve and having a portion thereof spaced from a lower end of the central electrode, the casing having a lower threaded portion for connecting the plug to a tapped opening defined in a cylinder cover, the improvement comprising means for defining an air passage between the threaded portion and a portion of the cylinder cover defining the opening so that ambient air can pass between the plug and cover portion, and wherein a separate ring assembly surrounds a portion of the plug, the ring assembly having passages formed therein for establishing fluid communication between the air passage and the ambient environment.

2. The improvement according to claim 1, wherein said ring assembly includes means for filtering air passing therethrough.

3. The improvement according to claim 1 or claim 2, wherein the ring assembly is positioned on an upper part of the lower threaded portion of the metal casing.

4. The improvement according to claim 1 or claim 2, wherein a ring recess is formed on the metal casing above the lower threaded portion to define a radial recess between the plug and the opening, the passages in the ring assembly and the air passage being fluid in communication with the radial recess.

5. The improvement according to claim 4, wherein the ring assembly surrounds the ring recess.

6. The improvement according to claim 1 or claim 2, wherein the means for defining an air passage comprises reduced diameter portions of the lower threaded portion of the casing, the reduced diameter portions being arranged vertically and being formed by filing off portions of the threads.

* * * * *